US009381443B2

(12) United States Patent
Barse

(10) Patent No.: US 9,381,443 B2
(45) Date of Patent: Jul. 5, 2016

(54) MULTI-POSITION ROLLING AND JUMPING TOY

(71) Applicant: PARROT, Paris (FR)

(72) Inventor: Thomas Barse, Aichi (JP)

(73) Assignee: PARROT, Paris (FR)

( * ) Notice: Subject to any disclaimer, the term of this patent is extended or adjusted under 35 U.S.C. 154(b) by 0 days.

(21) Appl. No.: 14/514,240

(22) Filed: Oct. 14, 2014

(65) Prior Publication Data

US 2015/0111463 A1 Apr. 23, 2015

(30) Foreign Application Priority Data

Oct. 18, 2013 (FR) ..... 13 60153

(51) Int. Cl.

| | |
|---|---|
| ***A63H 17/26*** | (2006.01) |
| ***A63H 33/00*** | (2006.01) |
| ***A63H 11/06*** | (2006.01) |
| ***A63H 17/00*** | (2006.01) |

(52) U.S. Cl.

CPC ..... *A63H 17/262* (2013.01); *A63H 11/06* (2013.01); *A63H 17/006* (2013.01); *A63H 33/005* (2013.01)

(58) Field of Classification Search

CPC ..... A63H 17/262

See application file for complete search history.

(56) References Cited

U.S. PATENT DOCUMENTS

| | | | | |
|---|---|---|---|---|
| 4,137,666 | A | 2/1979 | Ogawa | |
| 4,648,853 | A * | 3/1987 | Siegfried | A63H 17/262 180/7.1 |
| 5,100,153 | A | 3/1992 | Welte | |
| 5,487,692 | A * | 1/1996 | Mowrer | A63H 17/262 440/92 |
| 7,056,185 | B1 * | 6/2006 | Anagnostou | A63H 17/262 180/167 |
| 2008/0261487 | A1 * | 10/2008 | Torres | A63H 17/004 446/448 |

FOREIGN PATENT DOCUMENTS

| | | | |
|---|---|---|---|
| JP | 2011041696 | A | 3/2011 |
| WO | 2007130617 | A2 | 11/2007 |

* cited by examiner

*Primary Examiner* — Michael Dennis

(74) *Attorney, Agent, or Firm* — Haverstock & Owens LLP

(57) ABSTRACT

The present invention relates to a toy including a carriage (12), a pair of wheels (14), a sliding part (16) mobile along the carriage between extended and retracted positions, a spring stressed between the carriage and the sliding part, and means adapted to i) to progressively store a mechanical energy in the spring by displacement of the sliding part towards the retracted position, and ii) to release the thus-stored energy. The sliding part includes an end (32) supporting a jaw (34) and a pad (36). The carriage includes a protruding part (24) supporting another jaw (28) and another pad (30). The carriage may be oriented relative to the ground between several functionally distinct stable positions, with a default position where the toy rests in stable equilibrium on the two wheels and the pad (36), and a pulling/grasping position where the toy rests in stable equilibrium on the two wheels and the other pad (30) and where the second jaws is movable parallel to the ground, further or closer to the first jaw.

8 Claims, 3 Drawing Sheets

MULTI-POSITION ROLLING AND JUMPING TOY

FIELD OF THE INVENTION

The invention relates to a rolling and jumping toy including a pair of wheels arranged on either side of a body of the toy.

BACKGROUND OF THE INVENTION

Such a type of toy is disclosed for example in the JP 2011/41696 A (Barse).

SUMMARY OF THE INVENTION

This document describes a remote-controlled rolling and jumping object mounted on two independent wheels each driven by an individual motor, which allows the toy to move forward, to move rearward, to rotate, to take a jumping position, etc. The toy body includes a frame connected to the wheels and a sliding element guided on slides, with a spring interposed between the frame and the sliding element. A motor displace the sliding element closer to the frame, which as for effect to progressively compress the spring and to store therein an elastic potential energy. The unit is kept in this position by a locking system, which may be liberated to abruptly release the spring and to make the toy jump above the ground by transformation of the potential energy of the spring into kinetic energy, the impact of the sliding part against the ground producing, by reaction, the desired leaping effect. The height of the jump may be adjusted by a variable compression of the spring, allowing to deliver a more or less important energy at the time of the jump.

The object of the invention is to improve the toy, while keeping this base structure, by adding it with new functionalities in addition to the function of jumping toy, and this with a minimum of supplementary material means added to the base structure.

The object of the invention is also, at the same time, to improve the jumping function by allowing not only to adjust the energy of this jump, but also the jumping direction of the toy, by choosing to favour a high jump (for example to make the toy jump onto a table from the ground), or a long jump (for example to pass an obstacle, the toy ending its travel on the ground). The objects are achieved, according to the invention, by a rolling and jumping toy of the general type disclosed by the above-mentioned JP 2011/41696 A, i.e. a toy including:

- a wheeled-carriage, comprising a carriage and a pair of wheels arranged on either side of the carriage, the wheels being mounted with respect to the carriage so as to rotate about a common axis perpendicular to the main direction of the carriage;
- a sliding part, mobile in guided translation along the carriage, between two extreme positions, respectively extended and retracted;
- releasable means for locking the position of the sliding part relative to the carriage;
- first motor means, adapted to exert on the wheels a torque relative to the carriage;
- second motor means, adapted to move the sliding part relative to the carriage;
- a spring member stressed between the carriage and the sliding part; and
- spring-member control means, adapted i) to progressively store a mechanical energy in the spring member by displacement of the sliding part towards the retracted position under the action of the second motor means, and ii) to release the thus-stored energy, hence driving the sliding part towards the extended position under the effect of a liberation of the locking means.

Characteristically of the invention, to achieve the various objects mentioned above:

- the carriage supports a first jaw;
- the sliding part includes a protruding distal end supporting a second jaw, located opposite the first jaw, and mobile with the sliding part, as well as a contact pad;
- it moreover includes position control means, adapted to pilot in a coordinated manner the first and second motor means so as to move the carriage in rotation relative to ground, selectively between functionally distinct stable positions, comprising:
  - a default position, where said pad bears on the ground, the toy resting in stable equilibrium on the two wheels and said pad; and
  - a pulling/grasping position, where the toy rests in stable equilibrium on the two wheels with the distal end of the sliding part directed towards the ground, and where the second jaw is movable in a controlled manner parallel to the ground, further or closer to the first jaw, as well as, optionally
  - an inverted pendulum position, where the protruding distal portion of the carriage and the protruding distal end of the sliding part are directed away from the ground, the toy resting in instable equilibrium on its two wheels.

According to various advantageous subsidiary characteristics:

- the carriage is moreover integral with a protruding distal portion supporting, at a distance from the axis that is higher than the diameter of the wheels, the first jaw as well as another contact pad, and, in the pulling/grasping position, said other pad bears on the ground, the toy resting in stable equilibrium on the two wheels and said other pad;
- in the default position, the spring-member control means are adapted to release the energy stored in the spring member so as to cause a leap of the toy above the ground under the effect of the spring-back of the sliding part, transmitted by said pad;
- in the pulling/grasping position with the sliding part in the retracted position, the spring-member control means are adapted to release the energy stored in the spring member so as to throw away from the toy an object in contact with the second jaw, under the effect of the spring-back of the sliding part;
- in the pulling/grasping position with the sliding part in the extended position, the second motor means are adapted to move progressively the second jaw closer to the first jaw so as to allow the clamping of an object interposed between the first and the second jaws;
- in the default position, the second motor means are adapted to move progressively said pad closer to or further from the points of contact of the wheels with the ground, by relative displacement of the sliding part with respect to the carriage between the retracted position and extended position, so as to increase or reduce, respectively, the angle of inclination of the carriage with respect to the surface of the ground;
- the toy moreover comprises an optical device with a viewing direction, this optical device being carried by the carriage and being integral with the latter, the increase or the decrease of the angle of inclination of the carriage with respect to the surface of the ground having correlatively for effect to adjust on site the viewing direction of the optical device.

BRIEF DESCRIPTION OF THE DRAWINGS

An exemplary embodiment of the invention will now be described, with reference to the appended drawings in which the same references denote identical or functionally similar elements throughout the figures.

DETAILED DESCRIPTION OF THE INVENTION

Figure 1:
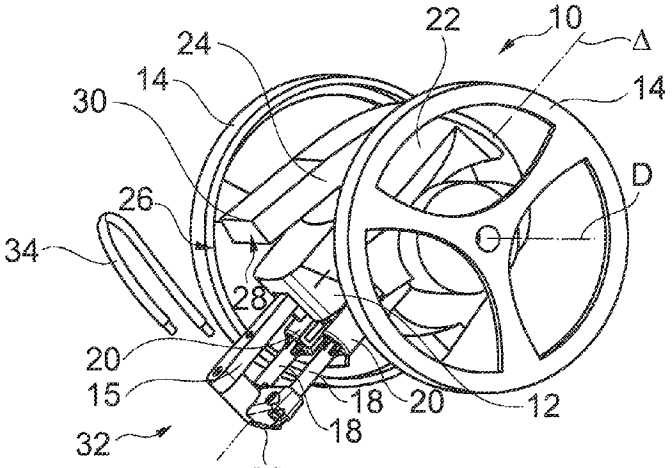
FIG. 1 is a perspective view of the toy according to the invention, showing the various elements which, combined together, constitute the structure thereof.

In FIG. 1, the reference 10 generally denotes the toy according to the invention, which comprises a carriage 12 supported by two wheels 14. The wheels 14 are mounted on the carriage 12 so as to pivot about a common axis D, and they are driven independently by individual electric motors (not shown), piloted by suitable circuits allowing the toy, according to the direction and speed of rotation of the wheels, to progress along a straight line, to move rearward, to turn about itself or to turn along a curve, etc., such different moves being advantageously controlled by the toy by means of a suitable remote-control.

The carriage 12 extends following a main direction Δ, perpendicular to the pivot axis D of the wheels, and it supports a sliding part 16 movable in translation parallel to the axis Δ under the effect of a suitable motor, piloted by the toy control circuits. This sliding part comprises for example two parallel rods 18 guided by respective cylinders 20 integral with the carriage 12, with interposition between the rods 18 and the cylinders 20 of one or several springs (not visible in the figures) serving as energy storage means, with compression of the spring when the sliding part 16 is moved closer to the carriage 12, and conversely returning to the sliding part 16 of the energy stored by these springs when the sliding part 16 is released towards an extend position of the carriage/sliding part unit. Moreover, it will be noted that, in the fully extended position of the sliding part, the end of the latter protrudes beyond the circumference of the wheels 14 and can hence come into contact with the ground.

The carriage 12 is integral with the body 22 of the toy, which is itself provided with a protuberance 24 protruding beyond the diameter of the wheels 22. The distal end 26 of the protuberance 24 has, according to a characteristic of the invention, a surface 28 directed towards the rear of the toy (i.e. towards the left with the convention of FIGS. 1 and 2), on the same side as the extension of the sliding part 16. This surface 28 constitutes a first jaw or cheek of a clamping device that will be described hereinafter, in particular with reference to FIG. 3*d*.

The protuberance 24 also carries at its distal end 26 a bearing element such as a ridge 30 that may form a first pad of contact with the ground in a configuration that will be explained hereinafter, in particular with reference to FIGS. 3*c* and 3*d*.

Besides, the distal end 32 of the sliding part 16, which protrudes beyond the diameter of the wheels 22, is provided with an element 34 forming the second jaw, arranged substantially opposite the surface 28 forming the first jaw. In the figure, this element 34 has been illustrated as a removable bow, but this particular form is given only by way of non-limitative example.

The distal end 32 of the sliding part 16 also comprises an element 36 such as a surface or a ridge directed towards the ground in the configuration of FIGS. 1 and 2, and which forms a second contact pad, liable to form a ground-bearing point for the toy, in the position illustrated in FIGS. 1 and 2.

The toy may also be provided with one or several optical devices 38 (FIG. 4*a*), such as a camera or a light, whose optical axis δ forms a fixed angle with respect to the main direction Δ of the carriage and of the toy body integral with this carriage. This device allows, for example, when the toy rolls, to light the front of the toy and/or to pick-up a video image of the site of operation, viewed from the toy.

Figure 2B:
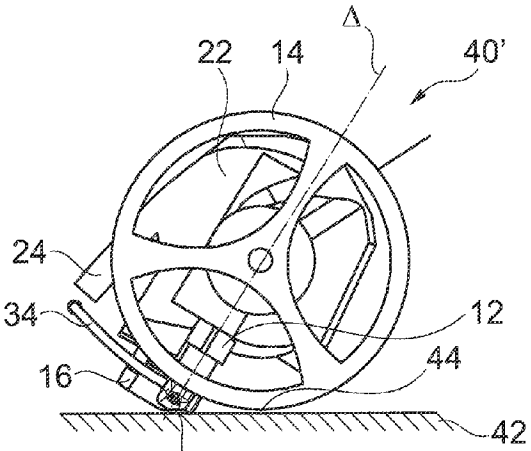
FIGS. 2*a* and 2*b* are side views illustrating the toy of the invention, in its default position, but according to two different inclinations, respectively.
Figure 2A:
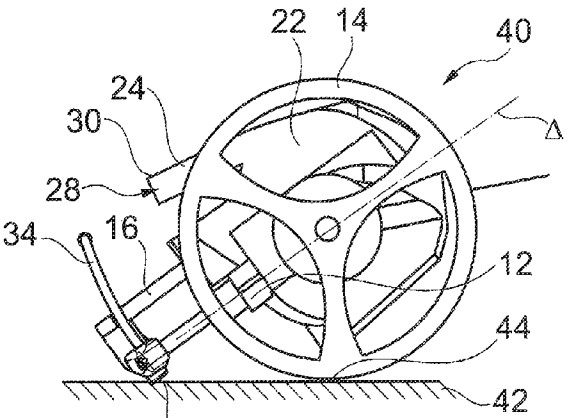

FIGS. 2*a* and 2*b* (as well as FIG. 3*a*, similar to FIG. 2*a*) illustrate a so-called "default" position among several positions that the toy is liable to take, the other positions being described hereinafter with reference to FIGS. 3*b* to 3*d*.

In this position, the toy rests on the ground 42 through three bearing points: the two contact points 44 of the wheels 14, and the second contact pad 36 at the distal end of the sliding part 16.

As mentioned above, the sliding part 16 forms a telescopic unit with the carriage 12, and it can hence move in translation between an extended position 40 (FIG. 2*a*) and a retracted position 40' (FIG. 2*b*) under the action of a motor specifically piloted to ensure this translation.

The displacement of the sliding part 16 produces a displacement of the ground-bearing point of the second pad 36, and correlatively a modification of the inclination of the carriage axis Δ, and thus the inclination of the toy and of the different elements that are linked thereto: it is in particular possible to adjust that way the orientation on site of the axis δ of the camera 38, the azimuth orientation resulting from the rotation of the toy about itself when the two wheels 14 are driven in opposite directions.

On the other hand, the default position 40 or 40' is that in which the toy is ready to jump (jumper position), by abrupt spring-back of the springs mounted between the sliding part and the carriage and that will have been previously compressed.

Characteristically of the invention, it is possible to favour a long jump or a high jump by positioning the toy with a more or less great inclination of the axis Δ: for example, the position 40 of FIG. 2*a* with an axis Δ slightly inclined will favour the length of the jump, whereas the position 40' of FIG. 2*b* with a axis Δ far more inclined upward will favour the height of the jump. FIGS. 3*a* to 3*d*, as well as FIGS. 4*a* to 4*d* that are similar but in perspective view, illustrate the different positions that the toy of the invention can take.

Figure 3B:
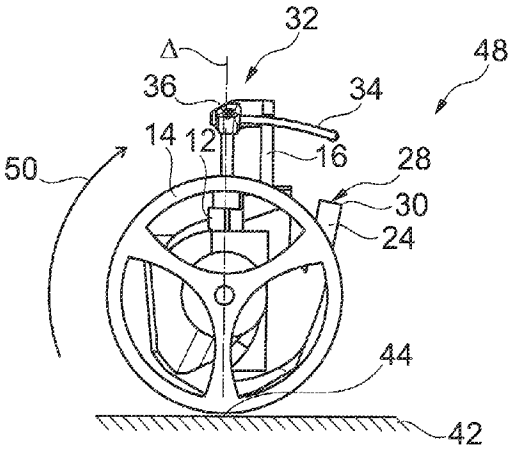
FIGS. 3*a* to 3*d* are side views illustrating the toy in the default position, in the inverted pendulum position, in the pulling position and in the grasping position, respectively.
Figure 3D:
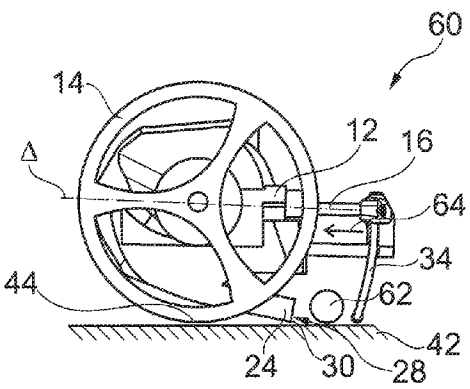
Figure 3A:
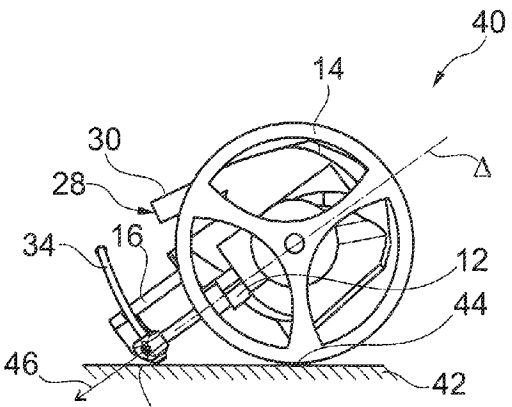
Figure 4B:
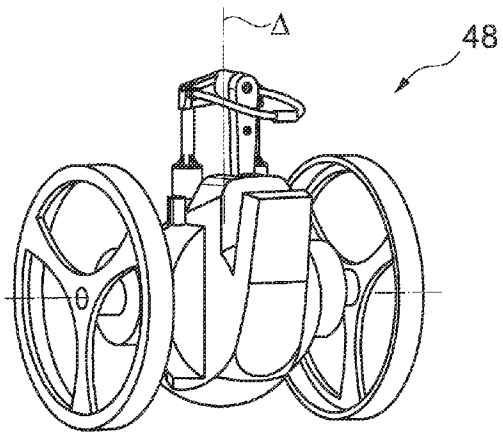
FIGS. 4*a* to 4*d* are similar to FIGS. 3*a* to 3*d*, in perspective view.
Figure 4D:
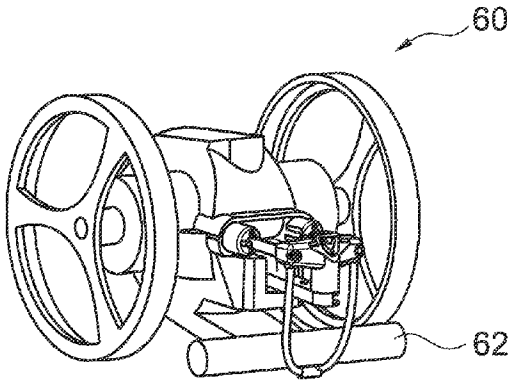
Figure 4A:
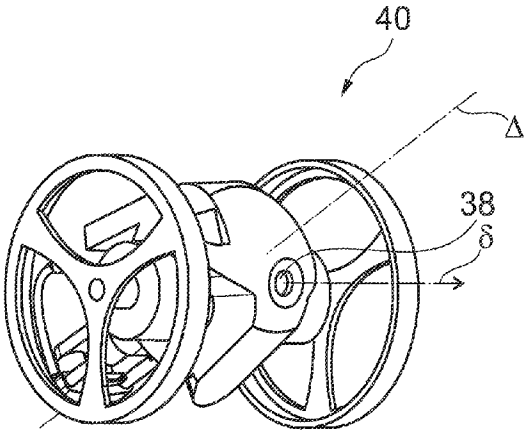

FIGS. 3*a* and 4*a* correspond to the "default" position that has just been described with reference to FIGS. 2*a* and 2*b*.

It is a naturally stable position, where the toy rests on the ground through three bearing points (the contact points 44 of the wheels and the second pad 36). This position allows in particular rolling on the ground, rotations, passage of obstacles, etc., and also constitutes the preparatory position for jumping, as described hereinabove, by abrupt release of the spring energy (schematised by arrow 46) via the second pad 36, this energy being transmitted, by inertia and reaction of the ground, to the toy body to cause the latter to leap.

FIGS. 3*b* and 4*b* illustrate another, so-called "inverted pendulum" position 48, where the protuberance 24 of the toy body is directed upward, as the distal end 32 of the sliding part 16.

In this position 48, there is no third bearing point, and the toy rests only on the two points 44 of contact of the wheels 14 with the ground. Besides, the relative position of the sliding part 16 with respect to the carriage 12 is not particularly important in this inverted pendulum position, where the jaws 28 and 34 have no operating purpose, neither have the contact pads 30 and 36, no energy release being further provided in this position.

The inverted pendulum position 48 may be reached from the position 40 by rotation of the toy body (arrow 50), this rotation resulting from a command of abrupt rearward acceleration: by inertia, the wheels almost not move and this is hence the body 22 that pivots about the axis D.

In this position 48, the centre of gravity of the toy is located above the axis D, so that the position is naturally instable and can be maintained only by a control of the wheel-piloting motor by feedback of the signal delivered for example by an orientation sensor or an inertial sensor incorporated in the toy body.

This position 48 may be an intermediate position, waiting for the selection of an action or the switching to another position (such as the positions illustrated in FIGS. 3*c* and 3*d*), or a full-fledged playing position, with possibility of rolling, rotation, etc., still with a feedback-control from the inertial sensor to maintain the toy body in equilibrium in the illustrated position, during these sequences of displacement.

Figure 3C:
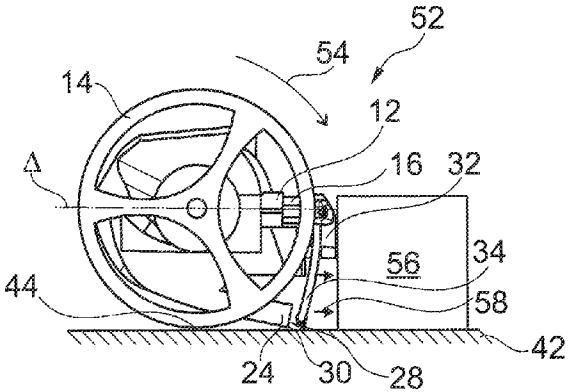
Figure 4C:
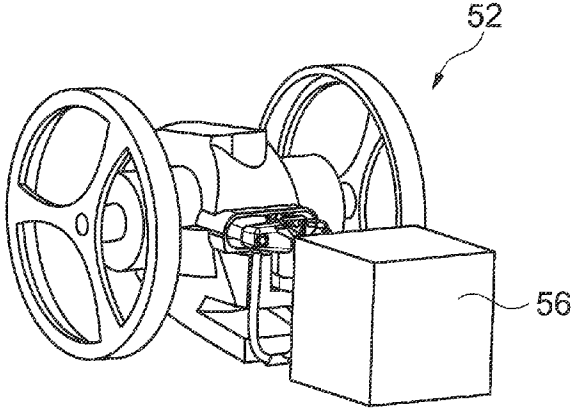

FIGS. 3*c* and 4*c* illustrate another, so-called "pulling" or "kicker", position of the toy. This position 52 is obtained from the default position 40 or the inverted pendulum position 48 by pivoting the body (arrow 54) in the same way as to reach the position 48, i.e. by an abrupt command of rear acceleration causing, by inertia, the toy body to pivot about the axis D, the wheels almost not moving.

This position is a naturally stable position, because the toy rests on the ground through three bearing points, i.e. the two contact points 44 of the wheels 14 and the first pad 30 of the protuberance 24 integral with the toy body and the carriage, which pad has come into contact with the ground at the end of the rotation 54.

It will however be noted that, in an alternative embodiment, the protruding portion or protuberance 24 of the toy body (and hence the first contact pad 30) could be omitted, the third bearing point being then consisted by the protruding distal end of the sliding part 16, or by the stirrup forming the second jaw 34, if such a stirrup is mounted at the end of the sliding part.

In the position 52, the second pad 36 and the second jaw 34 are placed opposite to each other, which allows to orient them towards an object (symbolized by the cube 56) which may serve as a projectile when the energy of the springs is abruptly released after these latter have been compressed by translation of the sliding part 16 from its extended position to its retracted position. The release of the springs and the abrupt return of the sliding part to the extended position has for effect to transmit the energy of the springs to the object 56 via the second pad 36 and/or the second jaws 34 (arrows 58). It will be noted that the process of compression/spring-back of the springs is the same as for the jumping function, but herein the energy stored by the springs is transmitted to an external object to propel it remote from the toy, instead of the toy being propelled by reaction of the ground.

FIGS. 3*d* and 4*d* still illustrate another possible, so-called "grasping" or "grabber"", position of the toy.

This position 60 is generally the same as that of the pulling position 52, to the only difference that the sliding part 16 is now in its extended position instead of being in its retracted position, and that there will be no use of the abrupt release of energy. Indeed, in the grasping position 60, the variable stroke of the sliding part (during the compression of the springs) is used to grasp an object (symbolized by the cylinder 62), this action resulting from the progressive translation of the second jaw 34 towards the first jaw 28 (arrow 64), here to move the sliding part 16 from its extended position towards its retracted position. It will be noted that the clamping remains moderated, the energy developed by the motor for the translation of the sliding part 16 being essentially absorbed by the springs. As illustrated, it is also possible to provide as the second jaw 34 a flexible bow, whose elasticity will allow to avoid any excessive compression of the object 62. The gasped object will then be able to be displaced, put at another place (by releasing the clamping by a reverse move of the sliding part 16), etc.

It will be noted that, although the two just-described positions are denoted "pulling" or "grasping" positions, such designations are not in any way limitative, and that other interactions than pulling or grasping are perfectly conceivable. This position (52 or 62) must be considered simply as a particular position allowing interactions that are similar to or different from the default position, and as a position in which the toy rests in stable equilibrium on the two wheels with the distal end of the sliding part directed towards the ground, with the second jaw movable in a controlled manner parallel to the ground, further or closer to the first jaw.

The invention claimed is:

1. A rolling and jumping toy (10) resting on the ground (42), including:

a wheeled-carriage, comprising a carriage (12) and a pair of wheels (14) arranged on either side of the carriage, the wheels being mounted with respect to the carriage so as to rotate about a common axis (D) perpendicular to a main direction (Δ) of the carriage;

a sliding part (16), movable along the carriage using one or more guides, between two extreme positions, respectively extended and retracted;

releasable means for locking the position of the sliding part relative to the carriage;

first motor means, adapted to exert on the wheels a torque relative to the carriage;

second motor means, adapted to move the sliding part relative to the carriage;

a spring member stressed between the carriage and the sliding part; and spring-member control means, adapted i) to progressively store a mechanical energy in the spring member by displacement of the sliding part towards the retracted position under action of the second motor means, and ii) to release the thus-stored energy, hence driving the sliding part towards the extended position upon unlocking the releasable means, said toy being characterized in that:

the carriage (12) supports a first jaw (28);

the sliding part includes a protruding distal end (32) supporting a second jaw (34), located opposite the first jaw, and movable with the sliding part, and a contact pad (36);

said toy includes position control means, adapted to pilot in a coordinated manner the first and second motor means so as to move the carriage in rotation relative to ground, selectively between at least two functionally distinct stable positions, comprising:

a default position (40), where said pad (36) provides support on the ground, the toy resting in stable equilibrium on the two wheels and said pad; and a pulling / grasping position (52, 60), where the toy rests in stable equilibrium on the two wheels with the distal end of the sliding part directed towards the ground, and where the second jaw is movable in a controlled manner parallel to the ground, further (58) or closer (64) to the first jaw.

2. The toy of claim 1, wherein:

the carriage is moreover integral with a protruding distal portion (24) supporting, at a distance from an axis that is higher than the diameter of the wheels, the first jaw (28) as well as another contact pad (30);

in the pulling/grasping position (52, 60), said other contact pad (30) bears on the ground, the toy resting in stable equilibrium on the two wheels and said other pad.

3. The toy of claim 1, wherein said at least two functionally distinct stable positions further comprise:

an inverted pendulum position (48), where the protruding distal portion (24) of the carriage and the protruding distal end (32) of the sliding part are directed away from the ground (42), the toy resting in instable equilibrium on its two wheels.

4. The toy of claim 1, wherein, in the default position (40), the spring-member control means are adapted to release the energy stored in the spring member so as to cause a leap of the toy above the ground under an effect of the spring-back (46) of the sliding part, transmitted by said pad (36).

5. The toy of claim 1, wherein, in the pulling/grasping position (52) with the sliding part in the retracted position, the spring-member control means are adapted to release the energy stored in the spring member so as to throw away from the toy an object (56) in contact with the second jaw (34), under an effect of the spring-back (58) of the sliding part.

6. The toy of claim 1, wherein, in the pulling/grasping position (60) with the sliding part in the extended position, the second motor means are adapted to move progressively (64) the second jaw (34) closer to the first jaw (28) so as to allow the clamping of an object (62) interposed between the first and the second jaws.

7. The toy of claim 1, wherein, in the default position (40, 40'), the second motor means are adapted to move progressively said pad (36) closer to or further from the points (44) of contact of the wheels with the ground, by relative displacement of the sliding part with respect to the carriage between the retracted position and extended position, so as to increase or reduce, respectively, an angle (Δ) of inclination of the carriage (12) with respect to the surface of the ground (42).

8. The toy of claim 7, wherein:

the toy moreover comprises an optical device (38) with a viewing direction (δ), this optical device being carried by the carriage (12) and being integral with the carriage (12), the increase or the decrease of the angle (Δ) of inclination of the carriage (12) with respect to the surface of the ground (42) having correlatively for effect to adjust on site the viewing angle (δ) of the optical device.

* * * * *